US007537574B2

(12) United States Patent
Gueret

(10) Patent No.: US 7,537,574 B2
(45) Date of Patent: May 26, 2009

(54) PACKAGING AND APPLICATOR UNIT FOR A PRODUCT INCLUDING A MASSAGE DEVICE

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 345 days.

(21) Appl. No.: 10/833,130

(22) Filed: Apr. 28, 2004

(65) Prior Publication Data

US 2005/0020948 A1 Jan. 27, 2005

Related U.S. Application Data

(60) Provisional application No. 60/473,159, filed on May 27, 2003.

(30) Foreign Application Priority Data

Apr. 29, 2003 (FR) ..... 03 05240

(51) Int. Cl.
*A61H 1/00* (2006.01)

(52) U.S. Cl. ..... 601/17; 601/18; 601/19

(58) Field of Classification Search ..... 601/17–19
See application file for complete search history.

(56) References Cited

U.S. PATENT DOCUMENTS

| | | | | | |
|---|---|---|---|---|---|
| 449,233 | A * | 3/1891 | Porter | 401/208 |
| 1,565,979 | A * | 12/1925 | Bachrach | 401/219 |
| 1,999,939 | A | 4/1935 | Luzzi | |
| 3,039,132 | A * | 6/1962 | Hambley | 401/220 |
| 3,083,397 | A * | 4/1963 | Thomas | 401/220 |
| 3,342,379 | A * | 9/1967 | Foley | 222/173 |
| 3,655,102 | A * | 4/1972 | Moran | 222/484 |
| 4,150,904 | A * | 4/1979 | Stewart | 401/186 |
| 4,747,720 | A * | 5/1988 | Bellehumeur et al. | 401/205 |
| 4,752,148 | A * | 6/1988 | Mann | 401/208 |
| 4,801,054 | A * | 1/1989 | Nycz | 222/545 |
| 4,909,265 | A * | 3/1990 | Goncalves | 132/317 |
| 5,213,431 | A * | 5/1993 | Gentile et al. | 401/219 |
| 5,218,955 | A * | 6/1993 | Gueret | 601/123 |
| 5,308,182 | A * | 5/1994 | Lampert | 401/219 |
| 5,395,175 | A * | 3/1995 | Bontoux et al. | 401/1 |
| 5,996,850 | A * | 12/1999 | Morali et al. | 222/173 |
| 6,010,264 | A * | 1/2000 | Scuderi et al. | 401/21 |
| 6,210,064 | B1 * | 4/2001 | White et al. | 401/279 |
| 6,224,286 | B1 * | 5/2001 | Villahoz | 401/219 |
| 6,244,776 | B1 * | 6/2001 | Wiley | 401/208 |
| 6,766,192 | B1 * | 7/2004 | D'Africa et al. | 604/20 |

FOREIGN PATENT DOCUMENTS

| | | |
|---|---|---|
| CH | 399217 | 3/1966 |
| EP | 0465348 | 1/1992 |

(Continued)

*Primary Examiner*—Michael A. Brown
(74) *Attorney, Agent, or Firm*—Oblon, Spivak, McClelland, Maier & Neustadt, P.C.

(57) ABSTRACT

A packaging and applicator unit for a product including a container having lengthwise axis X, with the container capable of holding the product. The container is provided at a first end with an aperture intended to dispense the product, with the aperture closed in a reversible manner by a closure element. At a second end opposite the first, one or more rotatable skin massaging elements are mounted.

76 Claims, 8 Drawing Sheets

FOREIGN PATENT DOCUMENTS

| | | |
|---|---|---|
| FR | 728367 | 7/1932 |
| FR | 926253 | 9/1947 |
| GB | 1023517 | 3/1966 |
| GB | 2374045 | 10/2002 |
| JP | 47-17784 | 10/1972 |
| JP | 48-94395 | 11/1973 |
| JP | 4-231957 | 8/1992 |
| JP | 10-28710 | 2/1998 |
| JP | 10-118196 | 5/1998 |
| JP | 10-118196 | * 12/1998 |

* cited by examiner

PACKAGING AND APPLICATOR UNIT FOR A PRODUCT INCLUDING A MASSAGE DEVICE

CROSS-REFERENCE TO RELATED APPLICATIONS

This document claims priority to French Application Number 03 05240, filed Apr. 29, 2003 and U.S. Provisional Application No. 60/473,159, filed May 27, 2003, the entire contents of which are hereby incorporated by reference.

BACKGROUND OF THE INVENTION

1. Field of the Invention

The present invention relates to a packaging and applicator unit for a product, including a device to massage the skin.

2. Discussion of Background

Devices for massaging the skin are known, for example as described in EP-B-0 465 348 and U.S. Pat. No. 1,999,939. Such devices are provided solely for massaging the skin.

Document FR 728 367 describes a device which includes a handle, with an alum stone in the form of a roller rotatably mounted at an end of the handle. The alum stone is thus deposited on the skin while imparting a massaging effect When applying certain cosmetic or skin care products, it can be useful to massage the skin before and/or after applying the product in order to promote its penetration into the skin.

Documents GB 1 023 517, GB 2 374 045, CH 399 217 and U.S. Pat. No. 6,010,264 describe "roll-on" type product applicators which include a reservoir with a single ball (or roller) rotatably mounted at an end of the reservoir. The product is able to flow around the ball such that the surface onto which the product is applied is massaged at the same time as the product is distributed. However, with such an arrangement, the massage ball or roller can become clogged in the course of repeated applications.

According to certain embodiments described in Documents GB 2 374 045 and CH 399 217, the second end of the container incorporates another single ball (or roller) used for the purposes of massage only. However, a single ball does not provide a truly effective massaging action on the skin.

For this reason, there is a need to provide a novel device which serves both to massage the skin and to apply the product. There is also a need to provide such a device that is simple to use.

SUMMARY OF THE INVENTION

According to one of its aspects, the invention provides a packaging and applicator unit for a product including a container having a lengthwise axis X, capable of holding the product. The container is provided, at a first end, with an aperture intended to dispense the product. The aperture is closed in a reversible manner by a closure element. At a second end, opposite the first, the arrangement includes at least two massaging elements mounted free in rotation.

In accordance with one of the advantageous features, the invention provides an arrangement in which the user can readily massage the skin and then apply the product on the massaged area simply by turning the unit through 180°. This notably makes it possible to perform alternating massage and product application treatments. In addition, such a unit avoids having to apply product to an area of the body and massaging this area simultaneously, which can clog the massage device.

The massaging elements can be mounted rotatably about axes of rotation, with the axes oriented in oblique or perpendicular directions with respect to each other.

By way of example, according to a preferred form, the directions of the two axes of rotation can form, in a first plane $P_1$, an angle $\alpha$ between 80° and 140°, and preferably between 100° and 120°.

The directions of the two axes of rotation can in addition form, in a second plane $P_2$ separate from $P_1$, an angle $\beta$ between 0° and 15°, and preferably between 1° and 5°.

The unit can include a means of adjusting the angle $\alpha$. This allows the massage device to be adapted to the area to which it is applied.

The massage elements can be detachably mounted, for example on the container or on a support fixed to the container.

The support carrying the massage elements can be fixed in relation to the container or can include at least one part capable of pivoting in relation to the container, for example a rotating platen.

The support can also be fixed in a detachable manner on the container, for example, by a snap-on attachment or by screwing. The unit can thereby include a means of detachment from the support to detach the support from the container when the support is fixed by means of a snap-on attachment or other detachable mounting arrangement. The massage device can thus be easily removed, for example to facilitate cleaning after use. This also makes it possible to separately market the container and closure element in the form of a refill, and to reuse the same massage device for each refill.

In accordance with an illustrated example, the massage elements can include flanges to facilitate rotation. The massage elements can also be rotatably mounted about a fitted pin.

The massage elements can be made of a flexible material, for example, an elastomer. In particular, the massage elements can be formed with a smooth surface, and a material can be utilized which adheres to the skin, for example, using some silicone or a SEBS, to assist in providing a massaging action with the massage elements.

When the massage elements are rotatably mounted about a pin such as a fitted pin, the fitted pin is preferably made of a material different from that of the massage elements. In particular the fitted pin is preferably made of a stiff material to limit friction and to facilitate rotation. Similarly, the flanges can be made of a stiff material.

The massage elements can include projections on their outer surface, and these projections can be formed with a constant or non-constant level or height on the massage elements. With these profiles of the rotating elements, the massaging action produces both a transverse oscillatory movement and a vertical oscillatory movement. The massage device imparts a progressive draining effect on the skin but preferably in an intermittent manner and with vibrations. The massaging action could also be provided in a gentler fashion.

The closure element can be a capsule or cover arrangement, for example a hinged capsule or cover, a screw-in capsule or cover arrangement, a ball type cover or a "push-pull" (in which the closure is moved between opened and closed positions by pushing and pulling upon a closure such as a nozzle or valve-type closure) type cover. The closure element can include a flat surface which is perpendicular to the axis X when the closure element is in the closed position. The unit can thus be stored with the closure element facing downward so that the product remains at the aperture end in this position, with the closure element providing a support for the device.

The container can form a grasping element. The container can also include walls capable of deforming in response to pressure exerted perpendicular to their surface, and of reverting to their initial shape when the pressure is relaxed.

In accordance with another object of the invention, independently or in combination with the foregoing, a packaging and applicator unit for a product is provided which includes a container having a lengthwise axis X, with the container capable of holding the product. The container is equipped at a first end with an aperture to dispense the product, with the aperture closed in a reversible manner by a closure element. In addition, at a second end opposite the first, a skin massaging device is provided, while the first end of the container does not have a massage device.

As should be apparent, various combinations with selected ones of the foregoing features can be provided in a given device. The arrangements of the invention can be particularly advantageous for packaging and dispensing a cosmetic or skin care product. The product can be a fluid product.

BRIEF DESCRIPTION OF THE DRAWINGS

The invention will become further apparent from the following detailed description, particularly when considered in conjunction with the drawings in which:

FIGS. 15A, 15B to 20A, 20B illustrate variants of the massaging elements of the packaging and applicator unit.

DETAILED DESCRIPTION OF THE PREFERRED EMBODIMENTS

Figure 1:
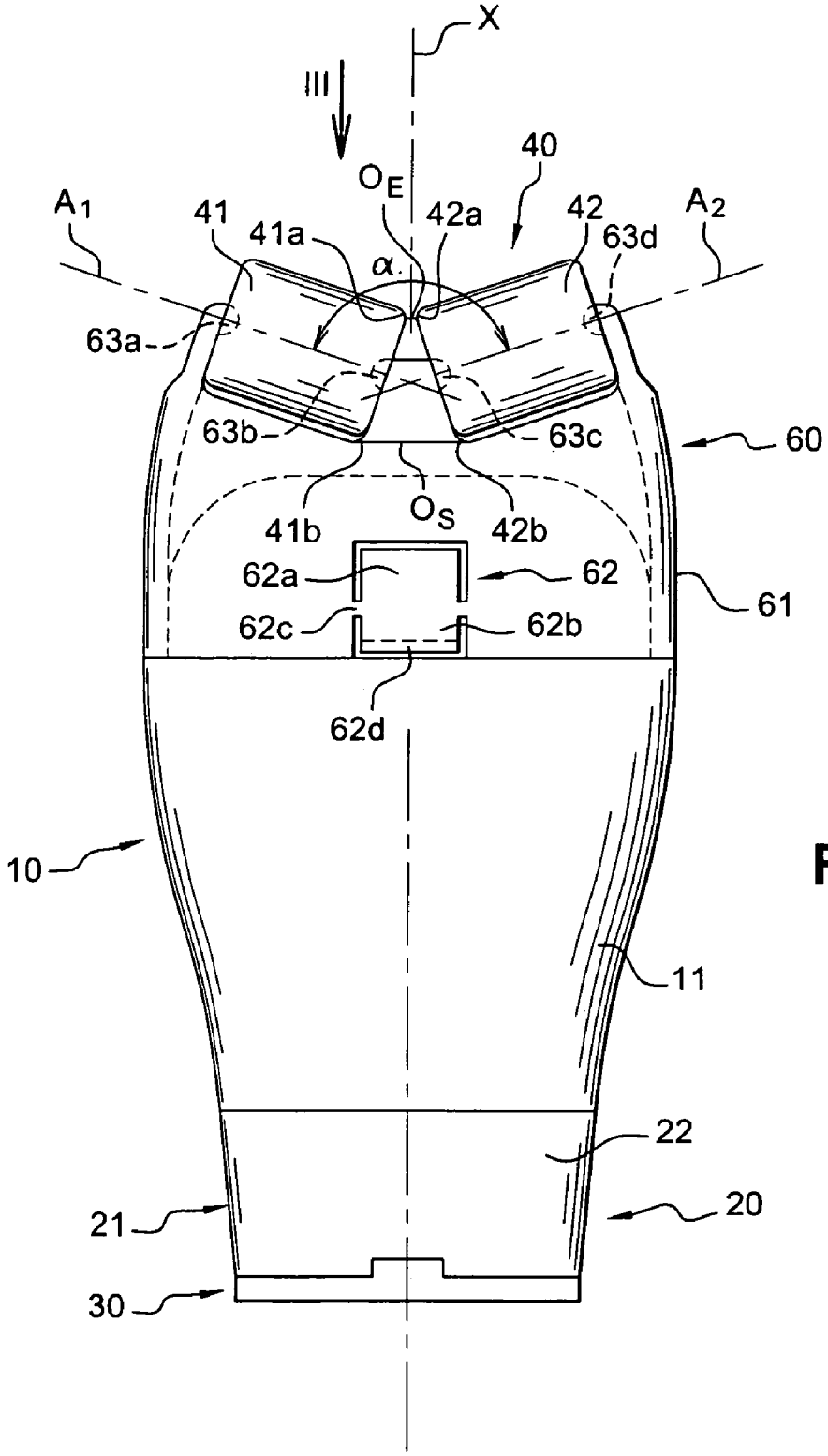
FIG. 1 illustrates a perspective view of a first embodiment of a packaging and applicator unit according to the invention.

The packaging and applicator unit shown in FIGS. 1 to 4 includes a container 10 in the form of a bottle containing the product and a skin massaging device 40, with the bottle being closed by a closure element such as a capsule or cover 20.

In the illustrated arrangement, by way of example, the bottle 10 includes a body 11 having a lengthwise axis X and an oblong transverse cross-section, and in particular a substantially oval cross-section in the example shown. With the arrangement shown, the transverse cross-section progressively increases from a first end 12 of the bottle which incorporates a neck 13 delineating an aperture 17, to a shoulder 14, beyond which the transverse cross-section becomes narrower and terminates at a base.

The body 11 of the bottle is preferably composed of one or more walls that are "elastically" deformable under the effect of pressure exerted perpendicular to their surface, with the walls being capable of reverting to their initial shape when the pressure is relaxed. The bottle is, for example, made of polyethylene or polypropylene, or coextruded with or without EVOH.

In the illustrated example, a capsule or cover closure arrangement 20 is snapped onto the neck 13 of the bottle.

The capsule 20 includes a body 21 which incorporates a covering skirt 22 of substantially oval transverse cross-section. The covering skirt 22 is open at one end and closed at the other end by a transverse wall 23. When the closure arrangement is mounted on the bottle, the covering skirt substantially forms a continuation of the body of the bottle.

The capsule also includes a cover or cap 30 formed by a substantially flat wall, with the cover being articulated on the body 21 by means of a film hinge 31, so that it is able to pivot about an axis Y constituting the axis of the hinge. Alternatively, it is possible to use a spring-effect hinge such as a toggle hinge, for example. In addition, as discussed earlier, various other types of closure elements could be utilized.

The transverse wall 23 of the capsule body incorporates an outlet aperture 24 for the product which emerges from the internal passage formed by the neck 13 of the bottle. In the illustrated example, the product outlet aperture 24 is arranged on an axis X which coincides with the axis of the bottle.

On its surface intended to face the transverse wall 23, the cover 30 includes a stud 32 capable of engaging in the outlet aperture 24 in a leaktight manner, thereby ensuring effective sealing of the closure.

A sealing skirt 25 carried by the transverse wall 23 is formed all around the aperture 24, and is centered on the axis X of the capsule. This sealing skirt is intended to be inserted in a leaktight manner inside the neck of the bottle.

To hold the capsule on the bottle, two skirt portions 26*a*, 26*b* are provided between the covering skirt 22 and the sealing skirt 25. Each skirt portion 26*a*, 26*b* incorporates a groove 27*a*, 27*b* in proximity to its free end, capable of receiving a bead 13*a* provided on the outer surface of the bottle neck so as to fix the capsule on the bottle by means of a snap-on attachment.

The cover 30 is held in the closed position on the body of the capsule by means of a lug 33 formed on the free edge of the cover, opposite the hinge, which fits into a recess 28 formed in the body of the capsule. Other attachment systems can alternatively be used. For example, the stud 32 can incorporate a small annular flange at its free end.

Figure 5:
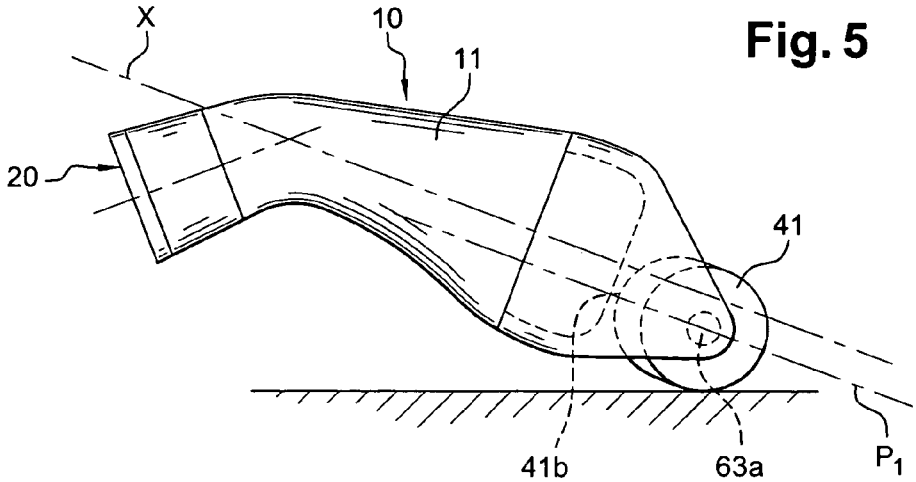
FIGS. 5 to 10 illustrate variants of the packaging and applicator unit according to the invention.

In the embodiment described above, the closure arrangement or capsule 20 is formed on the axis X of the container. It is evident that the capsule can be formed on an axis different from the axis of the bottle as illustrated, for example, in FIG. 5.

Opposite the capsule, the container is fitted with the massage device 40. The massage device 40 is mounted on the bottle 10 by means of a support 60 which carries the rotating massage elements 41 and 42.

The support 60 includes an attachment skirt 61 which is detachably fixed on the bottle 10. The attachment skirt 61 is open at a first end which enables it to accommodate the tapering portion of the bottle starting at the shoulder 14. An advantageously large holding capacity can thus be achieved to contain the product without making the device too cumbersome.

In the illustrated example, two diametrically opposite portions of the skirt incorporate two cutouts (only one of which is visible in FIGS. 1 and 2) each of which extends to the first end of the skirt. Each cutout forms a tab 62 which allows the skirt to be reversibly attached to the bottle. Each tab 62 is, for example, substantially rectangular and is formed by two portions 62*a* and 62*b* separated by a central portion 62*c* which is not cut out and around which the tab is able to move back and forth. As noted above, a similar arrangement can be provided on the side opposite to the side shown in FIGS. 1 and 2. Each of the tabs 62 additionally incorporates a rib 62*d* formed on its inner surface and intended to engage with or be disposed in a recess 15 formed on the tapering portion of the bottle so as to hold the support 60 on the bottle by means of a snap-on attachment. Above the recess 15, the bottle has a concave area 16 which can accommodate the portion 62*a* of the tab allowing it to tilt. As a variant, the skirt can include only one tab or more than two tabs. Thus, as is apparent from the drawings and the above description, to remove the massage assembly from the container, the user can press upon the tab portion 62*a* which removes the rib 62*d* from the recess to unlock the massage assembly so that it can be removed. Thus, as is apparent, the invention can include an arrangement to selectively lock and unlock the massage device, such as a support of the massage device, to the container.

Beyond the attachment skirt 61, the support 60 terminates in two pairs of lugs 63*a*, 63*b* and 63*c*, 63*d*, each pair emerging in an open recess 41' and 42' intended to receive a massage element 41 and 42. Each pair of lugs 63*a*, 63*b* and 63*c*, 63*d* defines an axis of rotation $A_1$ and $A_2$, about which the corresponding massage element is able to turn.

The massage elements 41 and 42 are rotating elements presented in the form of a roller. The rollers are made of a flexible material, for example, an elastomer or thermoplastic elastomer. The hardness of the rollers can be, for example, between 15 Shore A and 90 Shore D, preferably between 20 Shore A and 40 Shore D, and more preferably between 30 Shore A and 90 Shore A.

Figure 6:
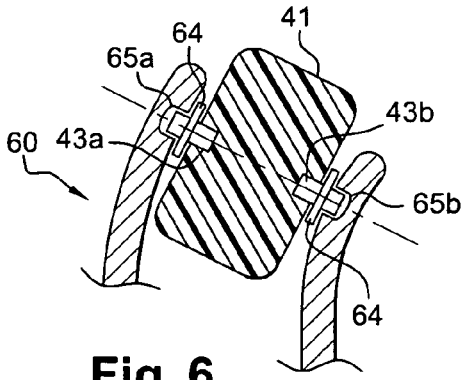
Figure 7:
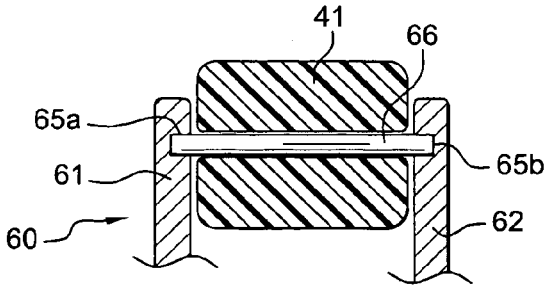
Figure 8:
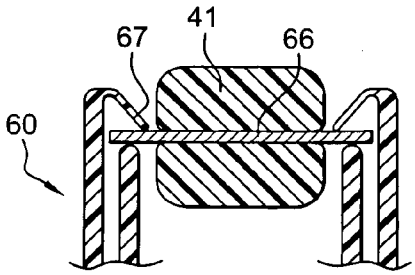

In this example, the two rollers 41 and 42 are identical and each is generally cylindrical in shape and has a relatively smooth surface. Each roller 41 and 42 has a lengthwise dimension, in the direction of its respective axis of rotation $A_1$ and $A_2$, greater than its largest transverse dimension which in this case is uniform and equal to the diameter of the roller. On their axis of rotation, the rollers 41 and 42 each have two cavities, 43*a*, 43*b* and 43*c*, 43*d*, each intended to receive one lug of the pair of lugs emerging into the corresponding recess. Each roller 41 and 42 is then free to rotate about its associated axis. In a variant partially illustrated in FIG. 6, an intermediate part 64 in the form of a flange is, on one hand, force fitted into each cavity 43*a*, 43*b* of a roller 41 and, on the other hand, mounted so as to rotate freely in a recess 65*a*, 65*b* provided in the support 60. In another variant illustrated in FIG. 7, the rollers 41 and 42 are mounted so as to be freely rotatable on a fitted pin 66 having its ends force fitted into a recess 65*a*, 65*b* provided in the support 60. Instead of being held by a force or interference fit into a recess, the fitted pin 66 can also be held by flexible fins 67 provided on the support as illustrated in FIG. 8. The flanges 64 and the fitted pin 66 are preferably made of a stiff material so as to limit friction and facilitate rotation.

In the example illustrated in FIG. 1, the rollers are mounted in a manner such that the axes $A_1$ and $A_2$ are substantially coplanar and their virtual extensions intersect forming an angle $\alpha$ in a plane $P_1$. This angle $\alpha$ is, for example, in the range of 80° to 140°, and more preferably from 100° to 120°.

The rollers 41 and 42 are also mounted so that, when the device is viewed in a plane $P_1$ with the massage device positioned upright as in FIG. 1, the two upper circular ends 41*a* and 42*a* of each roller 41 and 42 are closer together than the corresponding lower ends 41*b* and 42*b*. By way of example, the upper ends 41*a* and 42*a* can delineate between them an inlet aperture $O_E$ on the order of 2 mm and the lower ends 41*b* and 42*b* delineate between them an outlet aperture OS on the order of 20 mm.

Figure 4:
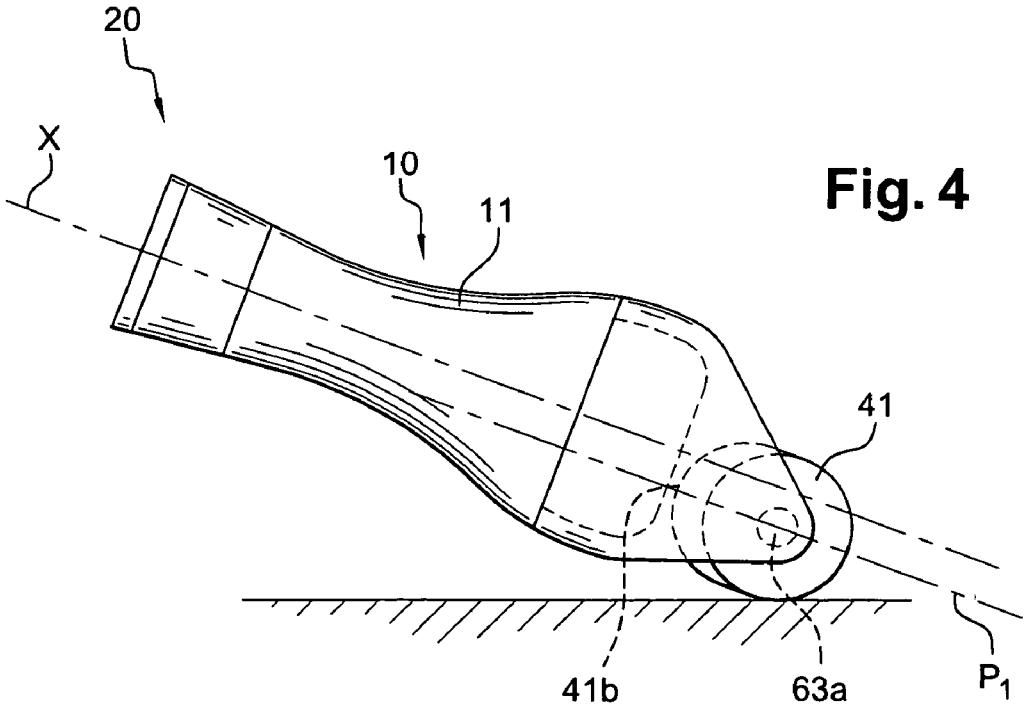
FIG. 4 illustrates the packaging and applicator unit shown in the previous figures being used for massage.

In order to use the device just described, the bottle is grasped and the massage device is applied onto the skin as illustrated in FIG. 4, and the device can then be moved across the skin. When the unit is moved to the left in FIG. 4, the rollers resting on and pressing lightly into the skin, roll and slide with friction on the skin. This sliding action with friction causes the skin to fold as the skin is initially exposed to the zone delineated by the large opening OS between the rollers towards the zone delineated by the small opening $O_E$ between the rollers. When the device is moved in the other direction, the skin does not undergo the same massaging action. For example, when moved to the right with respect to FIG. 4, the rollers also slide with friction and roll in a simultaneous manner, but the skin is subjected to slight stretching or relaxation.

Once the skin has been massaged, the device is turned over and the capsule is opened so as to apply the product contained in the bottle to the area of the body just massaged. Improved micro-circulation is observed following the massaging action, leading to improved skin tone and a significant reduction in water and grease at the surface of the skin, which means that after the skin has been massaged the device facilitates more rapid penetration of the massage product into the skin. An increase in the elasticity of the skin is also observed.

Figure 9:
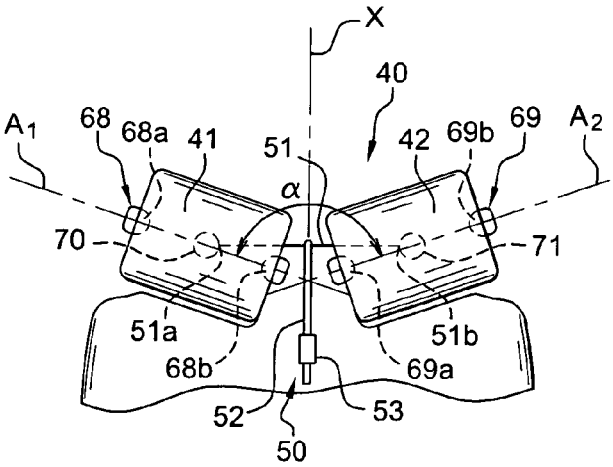

In a variant of the first embodiment illustrated in FIG. 9, the rollers 41 and 42 are connected to a first means 50 of adjusting the angle $\alpha$. In this embodiment, the rollers 41 and 42 are mounted on the attachment skirt 61 by means of forks 68 and 69 which terminate respectively in lugs 68*a*, 68*b* and 69*a*, 69*b* inserted into the cavities 43*a*, 43*b* and 43*c*, 43*d* of the rollers 41 and 42. Each fork includes in its central part a tube or rod 70, 71 friction-fitted into a slot formed in the attachment skirt 61. The adjustment means 50 includes a resiliently flexible blade 51 connecting each fork 68 and 69 carrying the rollers 41 and 42, with each end 51*a* and 51*b* of the blade being fixed respectively to a tube 70, 71. The blade 51 is attached approximately at its mid point to a rod 52 sliding in a direction parallel to the axis X. This rod 52 is slidably mounted in a stop 53 in the form of a thumbwheel accessible from outside the attachment skirt 61, and can be locked in several sliding positions. These different locking positions correspond to different values of the angle $\alpha$ formed by the rotating elements. Thus, with this example, the position of the rod 52 is adjusted to adjust the amount of flex in the blade 51 and thereby adjust the angle $\alpha$ between the rollers.

In a variant of the latter embodiment, not shown, the rollers can be mounted in the same way, i.e., by means of forks, without however being connected to an adjustment means. The rollers can then be oriented independently of each other, for example by turning them by hand. The tubes can, for example, turn freely in their corresponding slot or can incorporate fixed reference positions.

Figure 10:
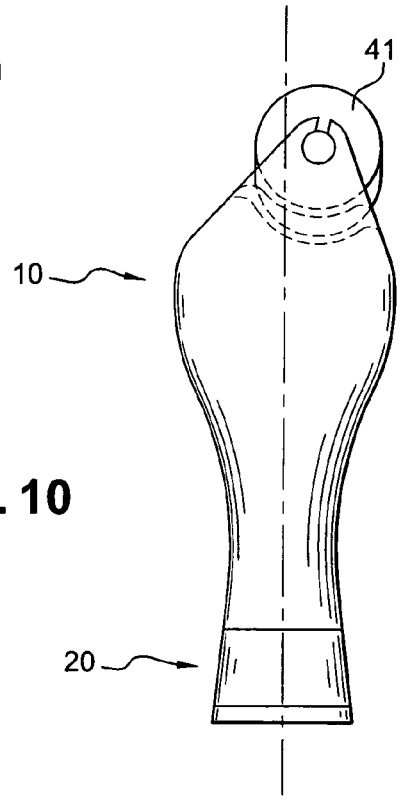

In another variant illustrated in FIG. 10, the rollers 41 and 42 can be rotatably mounted, not on a separable support 60, but directly on the bottle 10.

Figure 2:
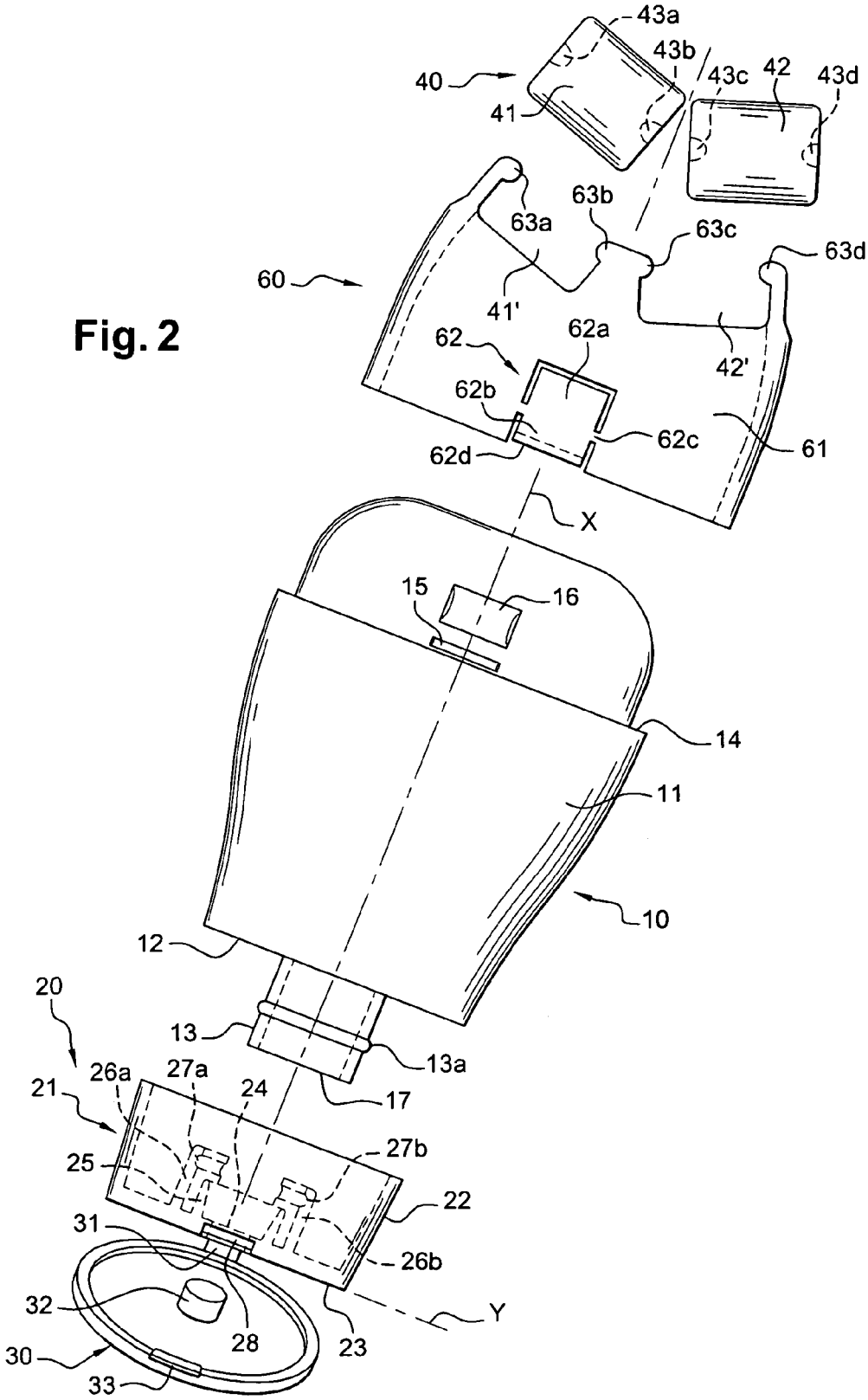
FIG. 2 illustrates an exploded view of the packaging and applicator unit in FIG. 1.
Figure 3:
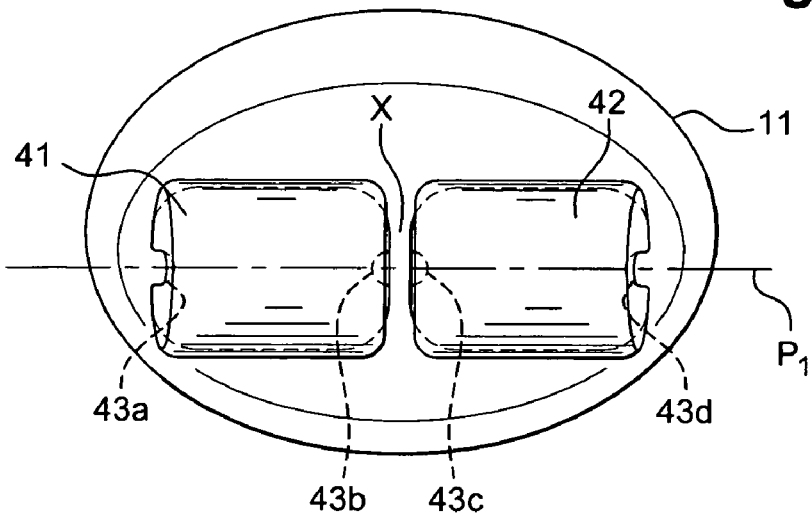
FIG. 3 illustrates a view on arrow III of the packaging and applicator unit shown in FIG. 1.
Figure 11:
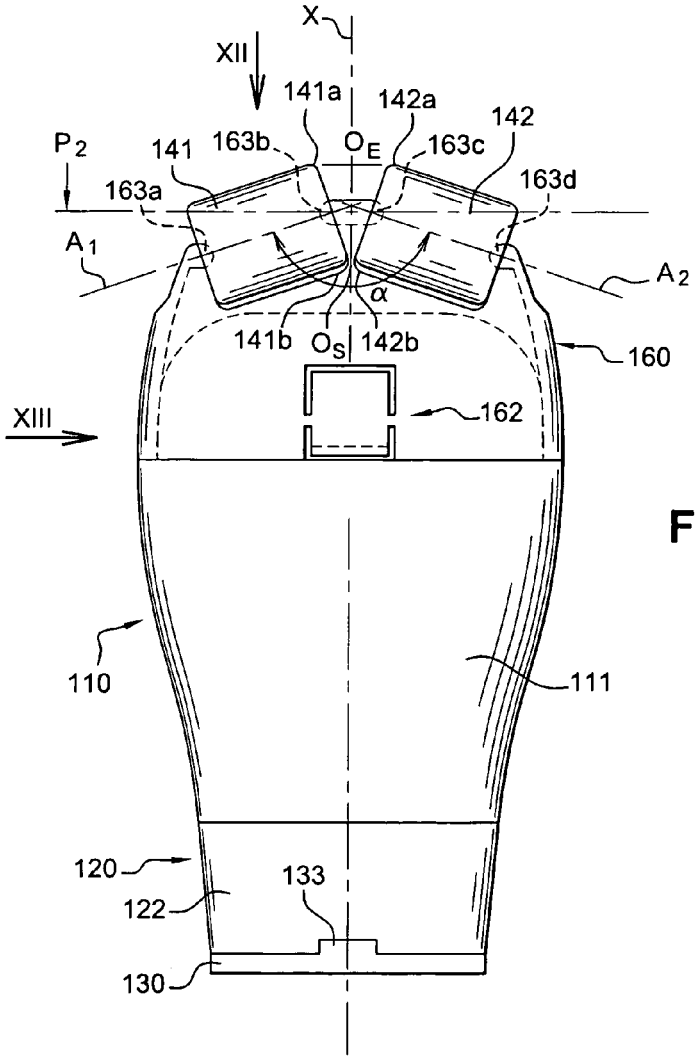
FIG. 11 illustrates a perspective view of another variant of the packaging and applicator unit according to the invention.
Figure 12:
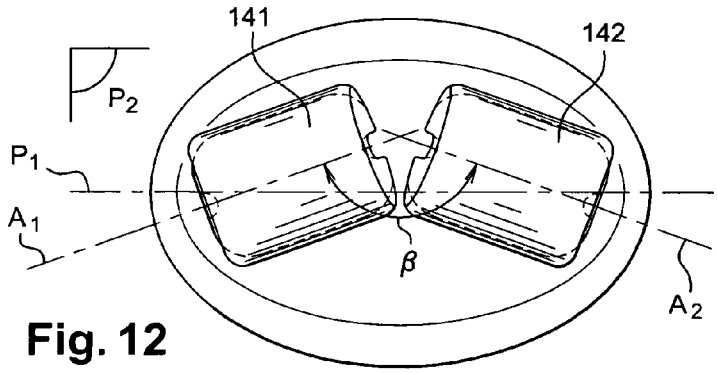
FIG. 12 illustrates a view on arrow XII of the packaging and applicator unit shown in FIG. 11.
Figure 13:
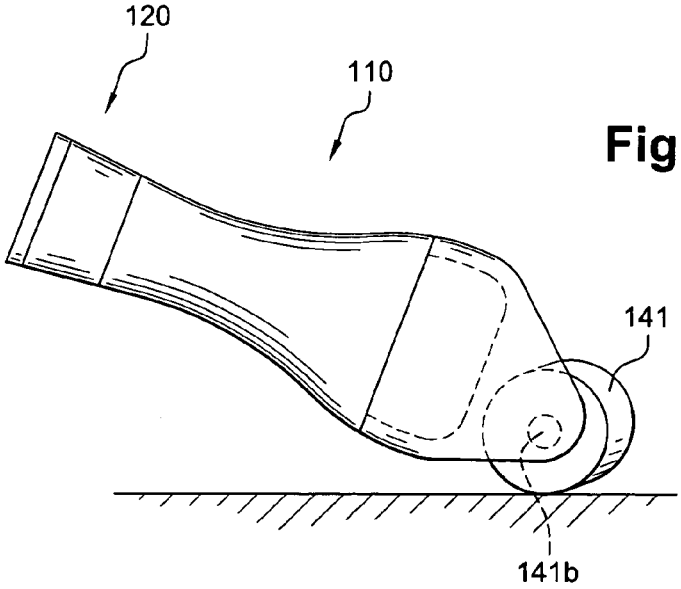
FIG. 13 illustrates a view on arrow XIII of the packaging and applicator unit shown in FIG. 11.

FIGS. 11 to 13 illustrate another embodiment of a device with two rotary elements in the form of rollers. Features analogous to those in FIGS. 1 to 3 are denoted by reference numerals increased by 100.

The angle $\alpha$ of the device in FIG. 11 is equal to the angle $\alpha$ of the device in FIG. 1. However, in this instance the rollers 141 and 142 are mounted so that, when the device is viewed in a plane $P_1$ with the massage device positioned upright as in FIG. 11, the two upper circular ends 141*a* and 142*a* of each roller 141 and 142 are further apart than the corresponding lower ends 141*b* and 142*b*. By way of example, the upper ends 141*a* and 142*a* delineate between them an inlet aperture $O_E$ on the order of 20 mm and the lower ends 141*b* and 142*b* delineate between them an outlet aperture $O_S$ of the order of 2 mm. This means that the rollers of the unit in FIG. 11 have a symmetrical position on the skin relative to the position of the rollers in FIG. 1 and that, consequently, the action of device in FIG. 13 will be substantially identical to that of the device in FIG. 4. However, the roll-and-fold action of the device in FIG. 13 is obtained by movement to the right, whereas the same roll-and-fold action was obtained by movement to the left using the device in FIG. 4. Also, in this device the axes $A_1$ and $A_2$ form an angle β in a plane $P_2$ perpendicular to $P_1$ as can be seen in FIG. 12. The angle β can be, for example, 0° to 15°, and more preferably from 1° to 5°.

Figure 14A:
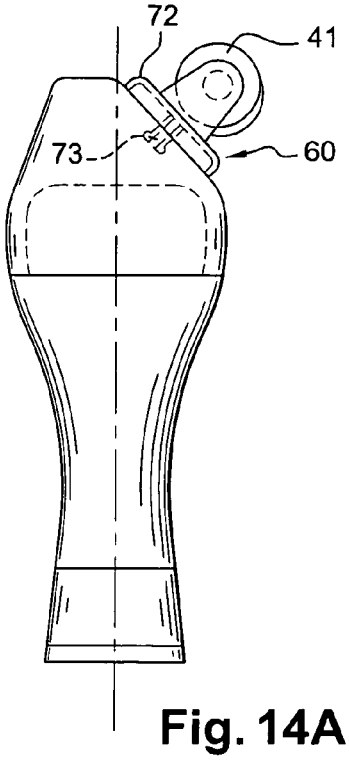
FIGS. 14A and 14B illustrate another variant of the packaging and applicator unit according to the invention.
Figure 14B:
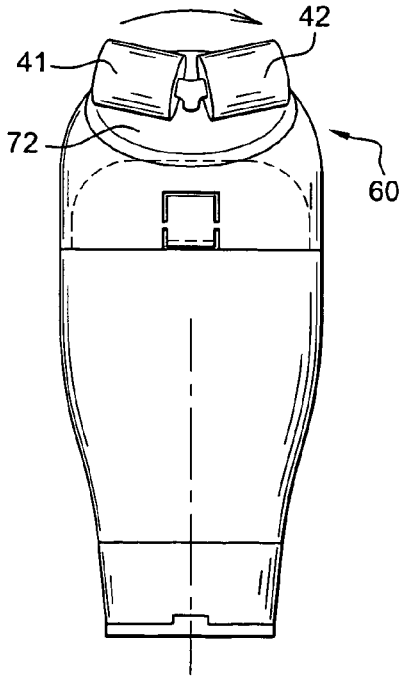

In another variant illustrated in FIGS. 14A and 14B, the support 60 can be movable in relation to the container so as to facilitate orientation of the rollers. The support can, for example, be in the form of a plate 72 mounted on a rod 73 capable of turning about its axis in a slot. The assembly can also be arranged for the rod to be freely rotatable in the slot or to have fixed reference positions. Thus, the rollers, i.e., the axes of the rollers, can be movably mounted relative to the container to vary the position of the rollers with respect to the container, for example, by rotating the support or a portion of the support which mounts the roller assembly to the container and/or by a rotatable coupling of the rollers to the support.

FIGS. 15A to 20B show in greater detail the diversity of possible shapes of the rollers for devices according to the present invention.

The lateral surfaces of the rollers in FIGS. 15A to 19B have projections. By way of example, each of these rollers has a straight cylindrical base surface from which various projections extend in a radial direction relative to the axis of rotation of the roller.

These rollers in FIGS. 15A to 19B, equipped with the various protuberances offset lengthwise or at different lengthwise or axial positions. Such massage elements can exert a vibratory and oscillatory action on the skin, in addition to the fold-and-roll action or relaxation of the skin in the other direction as discussed earlier.

Figure 15A:
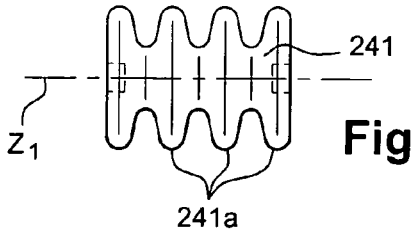
Figure 15B:
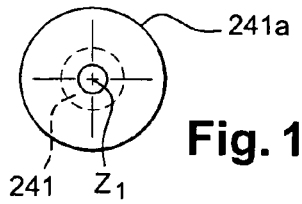

The rotary element in FIGS. 15A and 15B includes a cylinder shape 241 rotating about an axis $Z_1$. This cylinder 241 includes a plurality of radially extending projections 241*a* each having the shape of a circular disc.

Figure 16A:
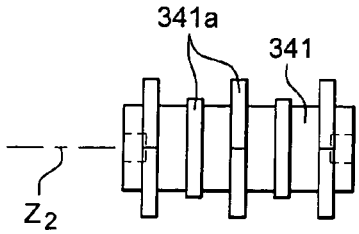
Figure 16B:
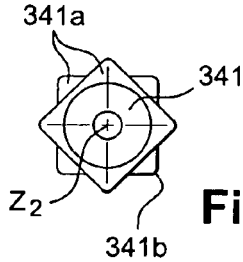

The rotary element in FIGS. 16A and 16B has a cylindrical shape 341 rotating about an axis $Z_2$. The cylinder includes radially extending projections having flat surfaces. As shown, the projections can have a polygonal shape, with the projections shown having the shape of a square 341*a* in which the corners 341*b* have been rounded. These squares are evenly spaced in the axial direction of the roller. In the illustrated example, all of the squares 341*a* are substantially identical in shape but the corners 341*b* of two successive squares are offset by an angle of 45° about the axis of the roller. The rounded edges of the corners 341*b* are all contained within a envelope of rotation about the axis $Z_2$.

Figure 17A:
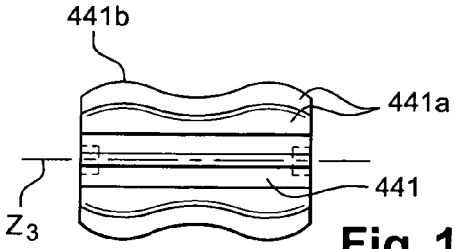
Figure 17B:
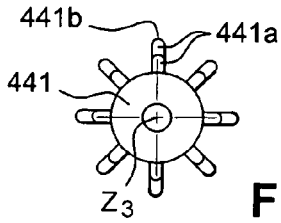

The rotary element illustrated in FIGS. 17A and 17B presents a cylinder shape 441 rotating about an axis $Z_3$. The cylinder 441 includes a plurality of radially extending wave-shaped projections 441*a*, each forming a continuous wall the median plane of which passes through the axis $Z_3$. These walls 441*a* have a radial edge 441*b* in the shape of waves extending in the lengthwise direction defined by the axis $Z_3$, such that the projections extend in the lengthwise direction of the roller with the height of the projections varying along the lengthwise or axial direction.

Figure 18A:
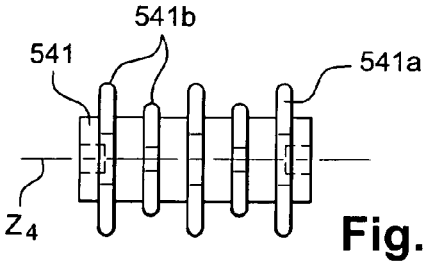
Figure 18B:
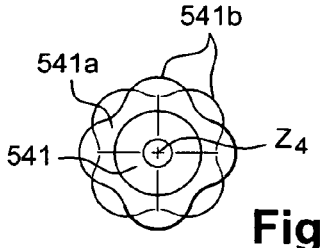

The rotary element in FIGS. 18A and 18B includes a cylinder shape 541 rotating about an axis $Z_1$. This cylinder 541 includes a plurality of radially extending projections 541*a*, each having the shape of a disc presenting a succession of waves 541*b* extending radially. In this illustrated example, each disc has a four-fold axis of symmetry oriented in the lengthwise direction defined by the axis $Z_4$. Accordingly, with this arrangement, the height of the projections varies about the periphery or circumferentially about the massage element. In addition, with the adjacent projections angularly offset, the height of the projections also varies along the length or in the axial direction of the massage element. In the illustrated arrangement, the waves 541*b* of two successive discs are angularly offset by an angle substantially equal to 45° about the axis $Z_4$.

Figure 19A:
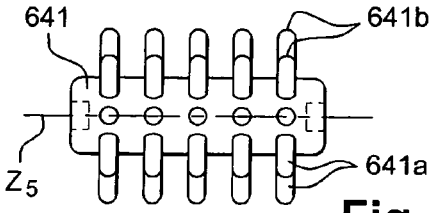
Figure 19B:
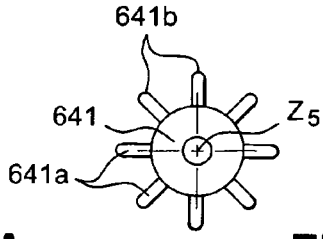

The rotary element shown in FIGS. 19A and 19B has a cylindrical shape 641 rotating about an axis $Z_5$. The cylinder includes a plurality of radially extending spaced pegs 641*a*. These pegs 641*a* are contained within a plurality of envelopes, each having the shape of a circular disc of the same size, with these geometrical envelopes being evenly spaced lengthwise relative to each other. In the illustrated example, the pegs are of equal size and therefore the ends 641*b* of all the pegs are contained within a cylindrical envelope about the axis $Z_5$. These ends 641*b* are spaced apart in the axial direction and in the peripheral direction of the rotary element.

Figure 20A:
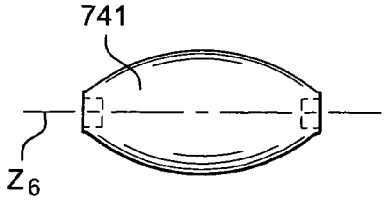
Figure 20B:
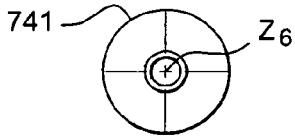

The rotary element illustrated in FIGS. 20A and 20B includes a cylindrical shape 741 rotating about an axis $Z_6$. The cylinder has a transverse cross-section which varies between its two ends with a maximum between them so as to form an olive shape. Thus, with this arrangement, the height or radius of the element also varies in the lengthwise or axial direction of the element. The external surface of the rotary element is substantially smooth.

As discussed earlier, the surface of the massage element can also include or be formed with a material which adheres to the skin (e.g., using some silicone or SEBS) to assist in providing a massaging action with the massaging element.

With the device according to the invention fitted with rollers or massage elements having profiles such as, for example, those defined above, a transverse oscillatory movement and a vertical oscillatory movement can be obtained during the massaging action. The massage device can impart a progressive draining effect on the skin in an intermittent manner and with vibrations.

In the foregoing detailed description reference is made to preferred embodiments of the invention. It is evident that variations thereto are possible without departing from the invention as claimed herebelow. The roller support can, for example, project beyond one width of the bottle so as to improve the manipulation of the device. The massage device can have a single roller or more than two rollers, for example, several pairs of rollers. Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging and applicator device for a product including:

a container which is capable of holding the product, the container having a lengthwise axis X, wherein the container includes an aperture at a first end to dispense the product from the container, and wherein the aperture is closed in a reversible manner by a closure element;

at least two skin massage elements, wherein said at least two skin massage elements are rotatably mounted, and wherein said at least two skin massage elements are disposed at a second end of said container which is opposite to said first end; and wherein said second end of said container does not have an opening such that said second end is permanently closed such that said product cannot be dispensed from said second end and such that the product is only dispensed from the first end.

2. A device according to claim 1, wherein the at least two skin massage elements are mounted to rotate about respective first and second axes of rotation, and wherein the first axis extends at a non-zero angle with respect to the second axis.

3. A device according to claim 2, wherein in a first plane $P_1$, an angle $\alpha$ between the first axis and the second axis is in a range of 80° to 140°.

4. A device according to claim 3, wherein said angle $\alpha$ is in a range of 100° to 120°.

5. A device according to claim 4, wherein the first and second axes of rotation form, in a second plane $P_2$ separate from $P_1$, an angle $\beta$ in a range of 0° to 15°.

6. A device according to claim 5, wherein said angle $\beta$ is in a range of 1° to 5°.

7. A device according to claim 3, wherein the first and second axes of rotation form, in a second plane $P_2$ separate from $P_1$, an angle $\beta$ in a range of 0° to 15°.

8. A device according to claim 7, wherein said angle $\beta$ is in a range of 1° to 5°.

9. A device according to claim 3, further including means to adjust the angle $\alpha$ .

10. A device according to claim 1, wherein the at least two skin massage elements are detachably mounted.

11. A device according to claim 1, wherein the at least two skin massage elements are mounted on the container.

12. A device according to claim 1, wherein the at least two skin massage elements are mounted on a support and wherein the support is fixed to the container.

13. A device according to claim 12, wherein at least part of said support is capable of pivoting relative to the container.

14. A device according to claim 13, wherein the support is detachably fixed on the container.

15. A device according to claim 12, wherein the support is detachably fixed on the container.

16. A device according to claim 15, wherein the support is detachably fixed to the container by a snap-on attachment.

17. A device according to claim 16, further including means to detach the support from the container.

18. A device according to claim 12, further including a locking arrangement to selectively lock the support to the container, and wherein the locking arrangement can be unlocked to detach the support from said container.

19. A device according to claim 1, further including at least one flange associated with each of the at least two massage elements to facilitate rotation.

20. A device according to claim 1, wherein the at least two skin massage elements are each mounted to rotate about a pin.

21. A device according to claim 20, wherein the pin is made of a material different from a material of the at least two skin massage elements.

22. A device according to claim 1, wherein the at least two skin massage elements include a flexible material.

23. A device according to claim 22, wherein the flexible material is an elastomer.

24. A device according to claim 1, wherein the at least two massage elements include a plurality of projections on their outer surface.

25. A device according to claim 24, wherein the plurality of projections have a constant height.

26. A device according to claim 24, wherein the plurality of projections have different heights.

27. A device according to claim 24, wherein the plurality of projections have heights which vary in a circumferential direction of the at least two skin massage elements.

28. A device according to claim 24, wherein the plurality of projections have heights which vary with respect to respective axial directions of the at least two skin massage elements.

29. A device according to claim 1, wherein the closure element is selected from the group consisting of a hinged cap, a screw-on cap, a ball element and a push-pull type closure element.

30. A device according to claim 29, wherein the closure element includes a flat surface which, when the closure element is in the closed position, is perpendicular to the axis X.

31. A device according to claim 1, wherein the closure element includes a flat surface which, when the closure element is in a the closed position, is perpendicular to the axis X.

32. A device according to claim 1, wherein the container forms a grasping element.

33. A device according to claim 1, wherein the container includes at least one wall capable of deforming in response to pressure exerted perpendicular to a surface of the at least one wall and of reverting to an initial shape when the pressure is relaxed.

34. A device according to claim 1, wherein the container contains a cosmetic.

35. A device according to claim 1, wherein the container contains a skin care product.

36. A device according to claim 1, wherein said at least two skin massage elements are mounted on a support and wherein said support is removably mounted on said second end of said container with at least a portion of said second end received inside of said support;

wherein said closure element includes a cap, and wherein said cap includes a flat surface which can support said packaging and applicator device in an upright position when said closure element is closed, and wherein in said upright position said at least two skin massage elements are at a top and said flat surface is at a bottom of said packaging and applicator device; and wherein said first and second ends of said container are positioned along said lengthwise axis X.

37. A device according to claim 36, further including a lock device to selectively lock and unlock said support to said container.

38. A device according to claim 1, wherein said closure element includes a substantially flat support so that said device can be supported on said closure element, and wherein said first end of said container does not include any massage elements.

39. A device according to claim 1, wherein said device includes a closure arrangement, wherein said closure element is part of said closure arrangement, wherein said closure arrangement further includes a skirt coupling said closure arrangement to said container, and wherein said closure arrangement further includes an outlet aperture, wherein the product passes through said aperture of said container and then through said outlet aperture of said closure element to be dispensed from said container; and wherein said closure element is movable relative to said skirt to selectively open and close said outlet aperture and thereby selectively open and close said container.

40. A device according to claim 39, wherein said aperture of said container is provided in a neck of said container, and wherein said skirt extends over said neck, and wherein said outlet aperture of said closure arrangement is smaller than said aperture of said container, and wherein said closure element is hingedly coupled to said skirt;

wherein said container includes a first shoulder at said first end and a second shoulder at said second end, and wherein said neck extends from said first shoulder, and further wherein said skirt of said closure arrangement extends around said neck and includes an outer periphery having substantially the same size and shape as a first cross-section of said container at an outer periphery of said first shoulder wherein a protrusion extends from said second shoulder;

wherein said at least two skin massage elements are mounted on a support, said support including a skirt having an outer periphery having substantially the same size and shape as a second cross-section of said container at an outer periphery of said second shoulder;

wherein the neck has a cross-section which is smaller than a cross-section of said protrusion extending from said second shoulder;

wherein said first cross-section of said container is smaller than said second cross-section of said container; and wherein said neck has a circular cross-section and said protrusion extending from said second shoulder has a non-circular cross-section.

41. A device according to claim 40, wherein the product is dispensed only through said aperture and said outlet aperture.

42. A device according to claim 1, wherein said container has a cross-section which progressively increases from said first end, and wherein said cross-section reaches a maximum cross-section at a location between said first and second ends and then decreases toward said second end.

43. A device according to claim 42, wherein said maximum cross-section is closer to said second end than said first end.

44. A device according to claim 43, wherein said container has a substantially oval cross-section.

45. A device according to claim 43, wherein said cross-section includes a first width and a second width extending in a plane perpendicular to said first width, and wherein both said first width and said second width increase from said first end toward said maximum cross-section.

46. A packaging and applicator device for a product including:

a container having a lengthwise axis X, capable of holding the product, said container including first and second ends at opposite ends thereof, and wherein a first shoulder is provided at said first end and a second shoulder is provided at said second end, said container further including a first protrusion extending from said first shoulder, said first protrusion having an outer periphery smaller than an outer periphery of said first shoulder such that said first protrusion has a cross-section smaller than a first cross-section of said container at the outer periphery of said first shoulder, and wherein said first protrusion is in the form of a neck having an aperture extending therethrough to dispense the product from the container, and wherein the aperture is closed in a reversible manner by a closure element, and further wherein said closure element includes a bottom support which supports said container in an upright position when said closure element is in a closed position and said bottom support is at a bottom of the device when the closure element is in a closed position and the container is supported in said upright position, and further wherein said closure element is associated with a closure arrangement that includes a first skirt extending to said first shoulder, and wherein said first skirt includes a cross-section having an outer periphery that is substantially the same size and shape as said first cross-section of said container;

said container further including a second protrusion extending from said second shoulder, said second protrusion having an outer periphery smaller than an outer periphery of said second shoulder such that said second protrusion has a cross-section smaller than a second cross-section of said container at the outer periphery of said second shoulder, and further wherein the cross-section of said second protrusion is larger than the cross-section of said first protrusion;

a support removably mounted on said second end of said container, said support including a second skirt which surrounds said second protrusion, and wherein said second skirt extends to said second shoulder, and wherein said second skirt includes a cross-section having an outer periphery that is substantially the same size and shape as the outer periphery of said second cross-section of said container;

wherein said second cross-section of said container is larger than said first cross-section of said container and an outer periphery of said second skirt is larger than an outer periphery of said first skirt;

a massaging device to massage the skin, wherein the massaging device is mounted on said support at the second end of said container, and further wherein the first end of the container does not include a massage device;

wherein when said container is in said upright position supported by said bottom support, said massage device is located at a top of said packaging and applicator device;

wherein said massage device includes at least two rotatable massage elements.

47. A device according to claim 46, wherein the container contains a cosmetic.

48. A device according to claim 46, wherein the container contains a skin care product.

49. A device according to claim 46, further including a lock device to selectively lock and unlock said support to said second protrusion of said container.

50. A device according to claim 49, wherein said lock device includes a rib associated with said support and a recess associated with said second protrusion of said container, and wherein said rib is positioned in the recess in said locked position.

51. A device according to claim 46, wherein said bottom support of said closure element includes a flat surface upon which said packaging and applicator device is supported in said upright position.

52. A device according to claim 51, wherein said closure element includes a cap coupled to the first skirt.

53. A device according to claim 52, wherein said first and second ends are both positioned along said lengthwise axis X.

54. A device according to claim 46, wherein said at least two rotatable massage elements respectively rotate about first and second axes of rotation, and wherein said first axis of rotation is disposed at a non-zero angle with respect to said second axis of rotation.

55. A device according to claim 54, wherein each of the at least two rotatable massage elements includes a plurality of projections.

56. A device according to claim 55, wherein said plurality of projections have heights which vary in an axial direction of said at least one massage element.

57. A device according to claim 56, wherein said plurality of projections have heights which vary in a circumferential direction of said at least one massage element.

58. A device according to claim 46, wherein said bottom support of said closure element includes a flat surface upon which said packaging and applicator device is supported in said upright position, wherein said first and second ends are both positioned along said lengthwise axis X, and wherein said second end of said container is permanently closed such that said product cannot be dispensed from said second end, and wherein said product can only be dispensed from said first end.

59. A device according to claim 46, wherein the cross-section of said first protrusion is circular and said cross-section of said second protrusion is non-circular.

60. A packaging and applicator device comprising:

a container having a first end and a second end, said container containing a product;

an aperture disposed at said first end, and wherein a closure element is associated with said aperture so that said product can be selectively dispensed from said container through said aperture, wherein said closure element includes a cap and a first skirt coupled to said first end of said container;

a support comprising a second skirt, wherein said support is removably mounted to said second end of said container, and wherein when said support is mounted to said container said second end of said container is at least partially received in said second skirt, and wherein the container does not have any apertures in any portion disposed within the second skirt such that said second end of said container is permanently closed; and at least one massage element mounted on said support;

wherein said at least one massage element includes a roller which is mounted to rotate about an axis.

61. A device according to claim 60, further including a locking device to selectively lock and unlock said support to said container.

62. A device according to claim 61, wherein said locking device includes a rib associated with said support and a recess associated with said container, and wherein in a locked position said rib is disposed in said recess.

63. A device according to claim 62, wherein said support includes a portion which, when pressed upon, moves said rib out of said recess to unlock said support from said container.

64. A device according to claim 60, including at least two massage elements.

65. A device according to claim 64, wherein the at least two massage elements each include a roller rotatable about respective first and second axes.

66. A device according to claim 65, wherein said first and second axes are disposed at a non-zero angle with respect to each other.

67. A device according to claim 60, wherein said at least one massage element includes a roller which rotates about an axis, and wherein the device further includes means for adjusting a position of said axis.

68. A device according to claim 60, wherein the product in said container is a cosmetic product.

69. A device according to claim 60, wherein the product in said container is a skin care product.

70. A device according to claim 60, wherein said container includes a first shoulder at said first end and a second shoulder at said second end, and wherein a first protrusion extends from said first shoulder and said aperture extends through said first protrusion, and wherein a second protrusion extends from said second shoulder and wherein said second skirt extends around said second protrusion; and wherein a cross-section of said first protrusion is smaller than a cross-section of said second protrusion, and further wherein said cross-section of said first protrusion is circular and said cross-section of said second protrusion is non-circular.

71. A packaging and applicator device comprising:

a container having a first end and a second end, said container containing a product;

an aperture disposed at said first end, and wherein a closure element is associated with said aperture so that said product can be selectively dispensed from said container through said aperture, wherein said closure element includes a cap and a first skirt coupled to said first end of said container;

a support comprising a second skirt, wherein said support is removably mounted to said second end of said container, and wherein when said support is mounted to said container said second end of said container is at least partially received in said second skirt; and at least one massage element mounted on said support;

wherein said container does not have an opening in said second end such that said second end is permanently closed and such that said product can be dispensed only from said first end;

wherein said closure element includes a flat surface which supports the packaging and applicator device in an upright position when the closure element is in a closed position;

wherein said container includes a longitudinal axis X which is perpendicular to said flat surface when said closure element is in the closed position, and wherein said first and second ends of said container are positioned along said longitudinal axis X;

wherein in said upright position said at least one massage element is at a top of said packaging and applicator device and said flat surface is at a bottom of said packaging and applicator device;

wherein said container has a cross-section which progressively increases from said first end, and wherein said cross-section reaches a maximum cross-section at a location between said first and second ends and then decreases toward said second end; and wherein said maximum cross-section is closer to said second end than said first end.

72. A device according to claim 71, wherein said cross-section includes a first width and a second width extending in a plane perpendicular to said first width, and wherein both said first width and said second width increase from said first end toward said maximum cross-section.

73. A device according to claim 72, wherein said cross-section is substantially oval.

74. A device according to claim 71, wherein said at least one massage element includes a rotatable massage element which is rotatable about an axis, and further wherein said cross-section includes a first width extending in a first plane, which is parallel to a plane in which said axis extends, and wherein said first width is largest at said maximum cross-section.

75. A device according to claim 74, wherein said cross-section further includes a second width extending in a second plane perpendicular to said first plane, and wherein said second width is largest at said maximum cross-section.

76. A device according to claim 75, wherein said container includes a first shoulder at said first end and a second shoulder at said second end, and wherein a first protrusion extends from said first shoulder and said aperture extends through said first protrusion, and wherein a second protrusion extends from said second shoulder and wherein said second skirt extends around said second protrusion; and wherein a cross-section of said first protrusion is smaller than a cross-section of said second protrusion, and further wherein said cross-section of said first protrusion is circular and said cross-section of said second protrusion is non-circular.

* * * * *